US007195333B2

(12) United States Patent
Huliba

(10) Patent No.: US 7,195,333 B2
(45) Date of Patent: Mar. 27, 2007

(54) INK JET PRINT STATION WITH IMPROVED START UP AND A METHOD FOR STARTING UP INKJET PRINTERS

(75) Inventor: David A. Huliba, Centerville, OH (US)

(73) Assignee: Eastman Kodak Company, Rochester, NY (US)

( * ) Notice: Subject to any disclaimer, the term of this patent is extended or adjusted under 35 U.S.C. 154(b) by 304 days.

(21) Appl. No.: 10/839,619

(22) Filed: May 5, 2004

(65) Prior Publication Data

US 2005/0248642 A1 Nov. 10, 2005

(51) Int. Cl.
*B41J 2/165* (2006.01)

(52) U.S. Cl. ..... 347/28; 347/29; 347/30; 347/35; 347/85

(58) Field of Classification Search ..... 347/85, 347/28, 29, 20, 35
See application file for complete search history.

(56) References Cited

U.S. PATENT DOCUMENTS 4,318,114 A * 3/1982 Huliba ..... 347/89
5,980,034 A * 11/1999 Tsai et al. ..... 347/89
6,174,052 B1 * 1/2001 Eremity et al. ..... 347/74
2002/0036672 A1 * 3/2002 Courtney et al. ..... 347/30
2002/0071010 A1 * 6/2002 Tachibana et al. ..... 347/77
2003/0156168 A1 * 8/2003 Enz ..... 347/75

FOREIGN PATENT DOCUMENTS

EP 1403061 3/2004
JP 11179932 A * 7/1999

* cited by examiner

*Primary Examiner*—Manish S. Shah
*Assistant Examiner*—Laura E Martin
(74) *Attorney, Agent, or Firm*—The Buskop Law Group, P.C.

(57) ABSTRACT

An ink jet print station with improved start-up reliability includes an ink reservoir and a printhead. The printhead has at least two drop generators, a return line connected to the generator's fluid ports, an orifice plate connected to the drop generator for forming jets, at least two filters, a controller for operating the valves to control flow, and an ink pump. The ink pump is adapted to move ink from the reservoir to the printhead. Upon startup, fluid is applied independently to the first filter and then the second filter. A method for at least partially filling filters in an ink jet uses the ink jet print station with improved start up reliability.

21 Claims, 2 Drawing Sheets

INK JET PRINT STATION WITH IMPROVED START UP AND A METHOD FOR STARTING UP INKJET PRINTERS

FIELD OF THE INVENTION

The present embodiments relate to filling the ink jet printing system filters, such as for those of dual-feed ink jet printheads during the initial introduction of ink into the printhead during startup.

BACKGROUND OF THE INVENTION

Under currently known ink jet printing system, when printheads first introduce ink to the system, the filters are typically only filled approximately ½ to ¾ full. With an only partially filled filter, problems can occur in operating the system. Problems particularly arise when trying to fill the remaining filter once pressure and flow are established. By closing one valve and opening another, a first filter at least partially filled requires a large pressure increase to fully wet out and at least partially fill the second filter. This large pressure increase is expensive, requiring additional energy, and with the increase in pressure, the potential to strain the system increases, causing leaks from other lines or seas.

A need exists for a method that will introduce ink into a printhead with a series of steps that will fill two printhead ink filters to a full position thereby controlling the amount of fluid that may weep from the printhead and minimize the pressure peaks that may occur that accidentally opening a shutdown valve in the system.

The embodied methods herein are designed to meet this need.

SUMMARY OF THE INVENTION

An improved ink jet printer start up and an ink jet print station with improved start up reliability includes a reservoir containing ink, a printhead fluid supply line, drop generator supply lines, associated valving, and a printhead. The printhead includes one or more drop generators with associated fluid ports, a return line connected to fluid ports, and an orifice plate connected to the drop generator for forming jets. Filters are connected between the valves and the fluid ports. A controller operates the valves, the ink pump, and the pressure transducer. The ink pump is connected to the drop generator fluid supply lines and operated by the controller and is adapted to move ink from the reservoir to the printhead. Upon startup, fluid is applied independently to the first filter and then the second filter.

The method for at least partially filling filters in an ink jet print station entails activating the pump at a drive level while opening a first valve to displace air from the first filter and at least partially filling the first filter with liquid and, then, shutting off the pump. The pump is activated at the drive level a second time while opening the second valve and closing the first valve to displace air from the second filter and at least partially filling the second filter with liquid. The first valve is opened to allow the liquid to circulate at a fixed pressure.

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The inventive method and ink jet printing station uses at least two filters. The method involves a series of steps that entail at least partially filling both ink filters independently and controlling the amount of fluid flow from the printhead.

The ink jet printing station involves the use of a printhead with a drop generator and two filters, an orifice structure, a charge device, a catcher, and an eyelid that can be actuated open or closed.

The method prevents the build up of ink in the gap created between the orifice structure and the eyelid, and minimizes the pressure peaks that may occur during filling of filters prior to entering a drop generator This method handles ink jet printhead filter filling pressures of 50 psi or less, in a manner that is safer than currently available techniques.

The methods have the added feature of keeping the filling pressure below 50 psi to create a more reliable performance of the printing system and a higher quality of printing.

The methods have advantageously shown an improved reliability because, by at least partially filling the filters first, the presence of air bubbles in this printing system is minimized. Air bubbles often cause failures in printing. The methods additionally provide a better balance of fluid flow between the two ports of a dual feed drop generator.

Figure 1:
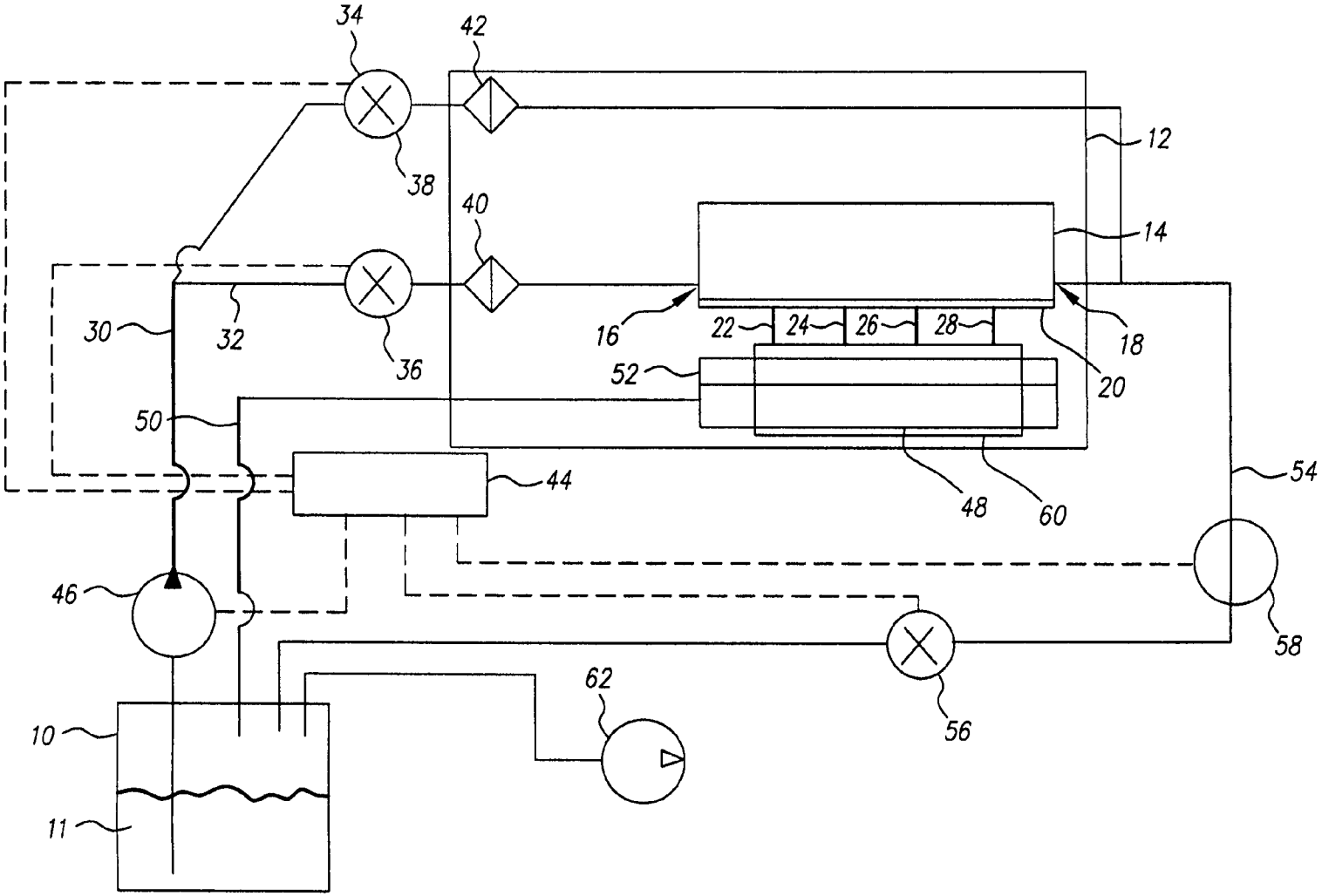
FIG. 1 depicts a schematic of an embodied fluid system.

With reference to the figures, FIG. 1 depicts an ink jet print station with improved start up reliability, wherein the print station includes a printhead 12 and a reservoir 10 containing ink 11. An example of an ink jet print station is a Kodak Versamark DT92 print station available from Kodak Versamark of Dayton, Ohio.

The printhead 12 includes a drop generator 14, having at least a first fluid port 16 and a second fluid port 18, and an orifice plate 20 connected to the drop generator forming a plurality of jets 22, 24, 26, and 28. A first filter 40 and a second filter 42 are connected to the drop generator as well as a return line 54 connected to the drop generator.

A printhead fluid supply line 30 connects the reservoir 10 with a first drop generator supply line 32 and a second drop generator supply line 34.

The first drop generator supply line 32 connects to the first fluid port 16 and the second drop generator supply line 34 connects to the second fluid port 18.

Additionally, a first valve 36 is disposed in the first drop generator supply line 32 between the printhead fluid supply line 30 and the first fluid port 16. A second valve 38 is disposed in the second drop generator supply line 34 between the printhead fluid supply line 30 and the second fluid port 18.

The reservoir 10 in a preferred embodiment can contain between one liter and six liters of ink. The ink can be a water-based ink, such as inks available from Kodak Versamark of Dayton, Ohio. The ink can also be a solvent-based ink, polymer-based inks, oil-based inks, dye-based inks, pigment-based inks and combinations thereof.

A first filter 40 is connected between the first valve 36 and the first fluid port 16. A second filter 42 is connected between the second valve 38 and the second fluid port 18.

A controller 44 communicates with the first valve and the second valve. The controller 44 communicates with an ink pump 46 connected to printhead fluid supply line 30. The controller 44 is adapted to move fluid from the reservoir 10 to the drop generator 14 upon startup. This system can be used to provide the fluid from the reservoir 10 independently to the first filter and then the second filter.

The controller can be an electronic controller with a central processing unit (CPU). The controller can control a plurality of valves, ink pumps and vacuum pumps in this system.

The system can optionally use a catcher 48 disposed opposite the drop generator 14. The catcher has a catcher return line 50 connecting the catcher to the reservoir 10.

A charge device 52, such as a charge plate, can be secured to the catcher for providing a charge to the drops from the jets 22, 24, 26 and 28 that are not to be used for printing.

A return line 54 connects the drop generator to the reservoir 10. A controllable valve 56 connected to the controller 44 disposed in the return line 54 can be used to open and close the return line. One or more pressure transducers 58 can be located in the return line between the drop generator and the controllable valve to sense the pressure in the system and communicate that information to the controller.

This system can be used to sequentially, at least partially fill a first filter to a full condition and then at least partially fill a second filter to a full condition. Alternatively, this system can be used to at least partially fill a first filter such as to three-quarters full, then a second filter to at least partially three-quarters full and then should the first filter have become less then full because ink has flowed into the drop generator, then at least partially filling the a filter once again.

The system can also utilize an eyelid 60 for sealing the fluid flowing to the catcher during start up. A vacuum pump 62 can optionally be connected to the reservoir 10 and the controller enabling fluid to be passed through the return line from the drop generator.

Figure 2:
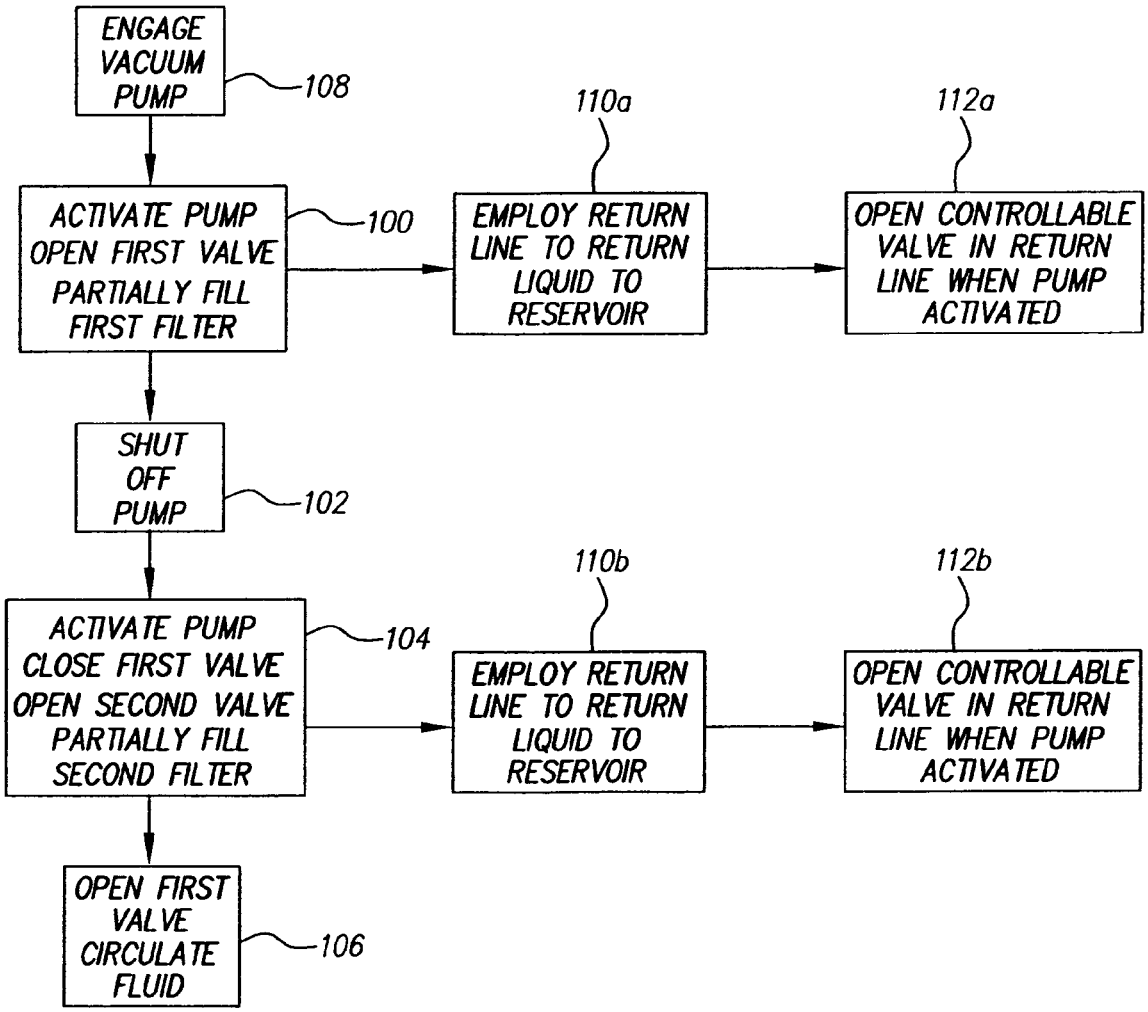
FIG. 2 depicts a block diagram of the method.

FIG. 2 depicts a method for filling filters for a system shown in FIG. 1. The steps involve first activating the pump 46 shown in FIG. 1 that can be an ink pump or a solvent fluid pump for pumping cleaning fluid through the printing station, at a drive level. A drive level is either a voltage level supplied to a pump or a duty cycle provided with a pulse width modulation (Step 100). Simultaneously, the first valve is opened to displace air from the first filter and at least partially filling the first filter with fluid. The second valve is kept closed. This orientation enables the first filter to be at least partially filled with liquid from the reservoir, which can be ink or cleaning fluid.

The next step involves shutting off the pump when the first filter is at least partially filled or more preferably, totally filled (Step 102).

The pump 46 is, then, again activated at the drive level a second time while opening the second valve and closing the first valve to displace air from the second filter and at least partially fill the second filter with liquid (Step 104).

After at least partially filling the second filter with ink, the first valve is opened, permitting the pump to circulate the liquid at a fixed pressure (Step 106).

The methods can be used to at least partially fill the first or the second filter to any capacity with liquid, but full is preferred.

The liquid usable in this method can be an ink or a solvent. If an ink is chosen, the ink can be a polymer-based ink, a solvent-based ink, or a water-based ink.

The fixed voltage or drive level of the pump at the first activation can be between 10 volts to 15 volts.

Prior to the first step the method could involve engaging a vacuum pump (Step 108) to pull fluid into the filters, such as ink, or ink out of the filters. Similarly, the vacuum pump can be used to pull cleaning fluid through the filters and other printhead components.

The method could additionally include concurrently with the first step, a step of employing a return line between either the first or second port of the drop generator and the reservoir to permit liquid to flush through at least one of the filters prior to being returned to the reservoir (Step 110*a* and Step 110*b*).

The methods additionally has a step of keeping a controllable valve in the return line open each time the pump turns on at a drive level and closed when the pump is turned off (Step 112*a* and Step 112*b*).

The methods can additionally have a step where the pump is shut off for between three seconds and six seconds.

The embodiments have been described in detail with particular reference to certain preferred embodiments thereof, but it will be understood that variations and modifications can be effected within the scope of the embodiments, especially to those skilled in the art.

PARTS LIST

10. reservoir
11. ink
12. printhead
14. drop generator
16. first fluid port
18. second fluid port
20. orifice plate
22. jet
24. jet
26. jet
28. jet
30. printhead fluid supply line
32. first drop generator supply line
34. second drop generator supply line
36. first valve
38. second valve
40. first filter
42. second filter
44. controller
46. pump
48. catcher
50. catcher return line
52. charge device
54. return line
56. controllable valve
58. pressure transducer
60. eyelid
62. vacuum pump

What is claimed is:

1. An ink jet print station with improved start up, wherein the ink jet print station comprises:

a. a reservoir containing a liquid;

b. a printhead fluid supply line connected to the reservoir;

c. a first drop generator supply line connected to the printhead fluid supply line;

d. a second drop generator supply line connected to the printhead fluid supply line;

e. a first valve disposed in the first drop generator supply line;

f. a second valve disposed in the second drop generator fluid supply line;

g. a printhead comprising:

i. a drop generator comprising at least a first fluid port and a second fluid port, wherein the first fluid port connects to the first drop generator supply line and the second fluid port connects to both the second drop generator supply line and a return line;

ii.

iii. an orifice plate connected to the drop generator for forming a plurality of jets;

iv. a first filter connected between the first valve and the first fluid port;

v. a second filter connected between the second valve and the second fluid port;

h. a controller for operating the first valve and the second valve; and i. a pump connected to the first and second generator fluid supply lines and operated by the controller, wherein the pump is activated to move the liquid, and wherein upon startup of the ink jet print station the controller is adapted to move the liquid via the pump independently to the first filter and then the second filter by activating the pump at a drive level, while opening the first valve, to displace air from the first filter and at least partially fill the first filter with the liquid, while the second valve is closed, then shutting off the pump, then re-activating the pump at the drive level, while opening the second valve and closing the first valve, to displace air from the second filter and at least partially fill the second filter with the liquid, and then opening the first valve to allow the liquid to circulate at a fixed pressure.

2. The ink jet print station of claim 1, further comprising a catcher connected to the drop generator.

3. The ink jet print station of claim 2, further comprising a catcher return line connected between the catcher and the reservoir.

4. The ink jet print station of claim 1, further comprising a charge device secured to the catcher.

5. The ink jet print station of claim 3, further comprising a controllable valve disposed in the catcher return line, wherein the controllable valve is adapted to open and close the catcher return line connected to the controller.

6. The ink jet print station of claim 5, further comprising at least one pressure transducer disposed in the catcher return line between the drop generator and the controllable valve.

7. The ink jet print station of claim 1, wherein the ink jet print station provides ink sequentially to one of the filters and then to the other filter.

8. The ink jet print station of claim 2, further comprising an eyelid for sealing the liquid when flowing to the catcher.

9. The ink jet print station of claim 1, wherein the reservoir is adapted to hold between one liter and six liters of ink.

10. The ink jet print station of claim 3, further comprising a vacuum pump connected to the reservoir, wherein the vacuum pump enables the reservoir to provide a reduced pressure to the catcher return line.

11. The ink jet print station of claim 1, wherein the controller is an electronic controller with a central processing unit.

12. A method for startup in an ink jet print station, wherein the ink jet print station, comprises:

a. a reservoir containing a liquid;

b. a printhead fluid supply line connected to the reservoir;

c. a first drop generator supply line connected to the printhead fluid supply line;

d. a second drop generator supply line connected to the printhead fluid supply line;

e. a first valve disposed in the first drop generator supply line;

f. a second valve disposed in the second drop generator fluid supply line;

g. a printhead comprising:

i. a drop generator comprising at least a first fluid port and a second fluid port, wherein the first fluid port connects to the first drop generator supply line and the second fluid port connects to both the second drop generator supply line and a return line;

ii. an orifice plate connected to the drop generator for forming a plurality of-jets;

iii. a first filter connected between the first valve and the first fluid port;

iv. a second filter connected between the second valve and the second fluid port;

h. a controller for operating the first valve and the second valve; and i. a pump connected to the first and second generator fluid supply lines and operated by the controller, wherein the pump can be activated to move the liquid, and wherein the method involves upon startup the controller moving the liquid via the pump independently to the first filter and then the second filter by the steps comprising:

activating the pump at a drive level, while opening the first valve, to displace air from the first filter and at least partially fill the first filter with the liquid, while the second valve is closed;

then shutting off the pump;

then re-activating the pump at the drive level, while opening the second valve and closing the first valve, to displace air from the second filter and at least partially fill the second filter with the liquid, and;

then opening the first valve to allow the liquid to circulate at a fixed pressure.

13. The method of claim 12, wherein the pump is an ink pump or a cleaning fluid pump.

14. The method of claim 12, wherein the fluid is a cleaning fluid or an ink.

15. The method of claim 12, wherein each filter is filled to at least three-quarters capacity with liquid.

16. The method of claim 13, wherein the ink is a water-based ink solvent based ink, polymer based inks, oil based, dye based inks, pigment based inks and combinations thereof.

17. The method of claim 14, wherein the drive level is between 10 volts to 15 volts.

18. The method of claim 12, further comprising the step of using a return line between either the first fluid port or second fluid port of the drop generator and the reservoir to permit liquid to flush through at least one of the filters to be returned to the reservoir, wherein the step is performed concurrently with the step concurrent with each activation of the pump at a drive level.

19. The method of claim 17, further comprising the step of engaging a vacuum pump prior any activation of the pump.

20. The method of claim 17, further comprising the step of using a controllable valve in the return line, wherein the controllable valve is open each time the pump turn is activated, and the controllable valve is closed when the pump deactivated.

21. The method of claim 12, wherein the pump is shut off for between three seconds and six seconds between the step of filling of the first filter and the filling of the second filter.

* * * * *

UNITED STATES PATENT AND TRADEMARK OFFICE

CERTIFICATE OF CORRECTION

PATENT NO. : 7,195,333 B2
APPLICATION NO. : 10/839619
DATED : March 27, 2007
INVENTOR(S) : David A. Huliba It is certified that error appears in the above-identified patent and that said Letters Patent is hereby corrected as shown below:

| | |
|---|---|
| Column 5, Line 6 | In Claim 1, after “line;” delete “ii.” |
| Column 5, Line 7 | In Claim 1, before “an” delete “iii.” and insert -- ii. --. |
| Column 5, Line 9 | In Claim 1, before “a” delete “iv.” and insert -- iii. --. |
| Column 5, Line 11 | In Claim 1, before “a” delete “v.” and insert -- iv. --. |
| Column 5, Line 17 | In Claim 1, after “pump” delete “is” and insert -- can be --. |
| Column 6, Line 12 | In Claim 12, delete “of-jets;” and insert -- of jets; --. |

Signed and Sealed this

Sixth Day of May, 2008

JON W. DUDAS
*Director of the United States Patent and Trademark Office*